United States Patent [19]

Vo Thanh et al.

[11] Patent Number: 4,770,395

[45] Date of Patent: Sep. 13, 1988

[54] TUNDISH

[75] Inventors: Khuong Vo Thanh, Montreal; Michel Rigaud, Ville Mont Royal, both of Canada

[73] Assignee: Sidbec Dosco Inc., Montreal, Canada

[21] Appl. No.: 62,575

[22] Filed: Jun. 16, 1987

[51] Int. Cl.[4] ..... C21B 3/00

[52] U.S. Cl. ..... 266/275; 164/335

[58] Field of Search ..... 266/275, 229, 230, 286; 164/437, 337, 335

[56] References Cited

U.S. PATENT DOCUMENTS

| | | | |
|---|---|---|---|
| 3,814,167 | 6/1974 | Listhuber et al. | 164/437 |
| 3,997,088 | 12/1976 | Buhrer | 164/337 |
| 4,043,543 | 8/1977 | Courtenay et al. | 266/275 |
| 4,125,146 | 11/1978 | Muller et al. | 266/229 |
| 4,177,855 | 12/1979 | Duchateau et al. | 266/275 |
| 4,323,108 | 4/1982 | Furjes et al. | 164/437 |
| 4,386,958 | 6/1983 | Tyler et al. | 266/229 |

FOREIGN PATENT DOCUMENTS

| | | | |
|---|---|---|---|
| 0664746 | 5/1979 | U.S.S.R. | 164/437 |

*Primary Examiner*—L. Dewayne Rutledge

*Assistant Examiner*—S. Kastler

*Attorney, Agent, or Firm*—Foley & Lardner, Schwartz, Jeffery, Schwaab, Mack, Blumenthal & Evans

[57] ABSTRACT

An improved tundish is disclosed, for use in combination with a casting ladle and a casting mold to continuously cast metal slabs. This tundish comprises an elongated, flat-bottomed basin known as a flotation box in between a pouring box with a vertical partition and an antivortex box. A first recess is provided in the bottom of the basin just under the partition to prevent any slag formed upstream of the partition from being entrained. The first recess also creates an upward stream rising from the bottom of the recess along the partition downstream the same, which allows optimal inclusion separation and substantial reduction of the dead volume zones in the basin downstream the partition. A second recess from which an outlet nozzle downwardly extends, is also provided in the bottom of the basin adjacent to the end of the flotation box. This second recess forms an antivortex volume above the outlet nozzle, thereby allowing substantial reduction of the metal left in the tundish on every casting sequence. This new configuration leads to better inclusion separation, less skulling and higher metallic yield.

2 Claims, 4 Drawing Sheets

TUNDISH

BACKGROUND OF THE INVENTION (a) Field of the invention

The present invention relates to a tundish of use in a continuous casting plant to continuously cast metal, especially steel.

(b) Brief description of the prior art

It is of common practice in any continuous casting process to use a piece of equipment called "tundish", for separating slags and other contaminants from the molten metal to be cast. Such a tundish is an intermediate vessel which is positioned between a casting ladle containing the molten metal to be cast, and a casting mold which is usually vertical. The molten metal is poured from the ladle into the tundish at one end thereof. The molten metal then flows along the vessel toward the other end thereof. The length of the vessel is selected to provide a time of residence of the metal in the tundish sufficient to allow separation of the inclusions as a floating slag layer. At the other end of the tundish, the molten metal free from its inclusions flows through a vertical outlet tube into the mold from which the solidifying cast slag is continuously drawn out.

Numerous studies have been made up to now to optimize the configuration and design of the existing tundishes, in order to achieve better inclusion separation, less slag entrainmment into the mold, less skulling and higher metallic yield.

The solutions that were proposed up to now to immprove flotation of the inclusions, have been:

(1) to increase the size of the tundish and more particularly its length; and/or (2) to add partitions, dams and weirs into this tundish (see, for example, U.S. Pat. Nos. 3,814,167 and 4,125,146) to increase the residence time of the molten metal in the tundish.

Each of these solutions have some advantages but none of them is actually adequate to achieve proper inclusion separation.

On the one hand, the use of conveniently located partitions, dams or weirs is certainly useful to increase the residence time of the metal in the tundish. However, such partitions weirs or dams generally create downstream stagnant volumes inside the tundish in addition of being subject to erosion causing contamination of the metal cast. Moreover, in the particular cases of dams, it is known that the efficiency of the dams increases with their height but that higher these dams are, the higher is the decrease in metallic yield.

On the other hand, increase of the width and length of the tundish is also certainly efficient to increase the residence time. However, such an increase of the size of the tundish is not recommended as it leads to greater metallic loss at the end of the casting process and greater dead volumes.

The present invention is based on the recognition that what is actually needed to obtain maximum inclusion flotation is to force the main metal stream in the upward direction toward the slag layer at the surface of the tundish. Such a recognitition has already been made by others (see, for example, U.S. Pat. No. 3,814,167). However, it has never optimized as now proposed in accordance with the present invention.

The invention is also based on the recognition that once the inclusions have been raised and trapped into the slag layer, it is imperative not to draw them down again through the submerged outlet nozzle into the mold. In this connection, it is well known in this art that vortexing above tundish outlet nozzle must be avoided. It is also known that the probability of formation of a vortex increases as the flow of metal, hence the casting speed, increases. To maintain the surface quality of the slab being cast, it is not practical to reduce the casting speed. Therefore, the solutions that have been proposed up to now are:

(1) to keep the metal level in the tundish high, and (2) to avoid turbulent flows around the nozzle due to convectively induced current.

In the former case, it is of normal practice to keep a head of about 20 cm of metal above the nozzle orifice to avoid slag entrainment. The amount of metal that must remain in the tundish when the same has a flat bottom to maintain this head of about 20 cm, is very costly in terms of metallic yield. Indeed, the larger is the tundish, the higher is the cost, as the amount of metal that may remain "trapped" in the tundish may vary from 3 to 6 tons per sequence in a slab caster of a conventional size (about 4 m long, 1 m wide and 90 cm depth). This, in practice, may represent a loss of about 5,000 tons per year.

In the latter case, it has already been suggested to change the flow characteristic surrounding the nozzle by changing the orifice geometry or by using castellated nozzle or other means. These solutions are however rather costly to reduce into practice.

The invention further is based on the recognition that the use a tundish not as a mere vessel interposed between a ladle and a mold to act as a constant head reservoir, but rather as an open chemical reactor in which reactive alloys such as Ca or CaSi may be added to the molten metal to adjust the metal concentration and minimize the intermixting which usually occurs in the sequential casting, is rather difficult as a plurality of conflicting conditions must be met. Indeed, to proceed to such a "tundish metallurgy", it is compulsory that the tundish be not too deep to float out the newly formed inclusions. However, to avoid vortexing, a sufficient pressure head must be maintained. To homogenize rapidly the alloy additions into the tundish, it is also compulsory that the volume of metal which is subjected to high turbulences and therefore well mixed, must be large enough, which means that the height of injection of the molten metal poured from the ladle must be important. However, the larger the well mixed volume is, the bigger the tundish must be to obtain a reasonable fraction of plug flow volume desirable for inclusion separation. This again mitigates against good metallic yield and increases to possibility of creating dead volumes.

OBJECT OF THE INVENTION

The object of the invention is to provide a tundish for constinuously cast metal slabs, which tundish has an optimized configuration which promotes inclusion flotation and separation, allows alloy adjustment and minimizes intermixing in sequential casting.

More particularly, the object of the present invention is to provide a tundish having such an optimized structure and configuration as:

(1) to reduce turbulences and vortexing above the tundish nozzle at low level of metal in the tundish, in order to increase the metallic yield at the end of every sequence;

(2) to guide the molten metal supplied at one end of the tundish in the upward direction to the surface in order to achieve better inclusion separation; and (3) to maximize the fraction of the tundish volume which is in plug flow to improve the internal cleanliness of the tundish; and (4) to minimize the dead zone volume inside the tundish, which volume is known to be responsible for skulling.

Therefore, the object of the present invention is to provide a tundish having better inclusion separation, less slag entrainment into the mold, les skulling and higher metallic yield than any other tundish known in the art.

SUMMARY OF THE INVENTION

In accordance with the invention, the above mentioned object is achieved with a tundish for use in combination with the casting ladle and a casting mold to continuously cast metal slabs, especially steel metal slabs, which tundish comprises:

an elongated basin having an open top, a flat bottom wall, a pair of opposite end walls and a pair of opposite side walls;

a first recess provided in the bottom wall in the basin at a given distance from one of the opposite end walls of this basin, the first recess extending downwardly and transversally across the basin between the side walls thereof and having a bottom wall and a pair of opposite walls perpendicular to the side wall basin;

a vertical partition extending transversally across the basin between the side walls thereof just over the first recess, this partition extending vertically from the top of the basin down into the first recess at about mid distance between the opposite walls thereof, this partition stopping short from the bottom wall of the recess to form therewith the baffle;

a second recess provided in the bottom wall of the basin adjacent the other end wall thereof, this second recess extending downwardly and transversally across the basin between the side walls thereof and having a bottom wall provided with the central opening; and an outlet nozzle extending downwardly from the central opening of the second recess through the bottom wall thereof.

The vertical partition of the tundish according to the invention divides the basin into a first portion hereinafter called "pouring box", extending from the partition towards the one end wall of the basin, and a second portion hereinafter called "flotation box" extending from the partition towards the other end wall of the basin. Of course, all of the walls of the basin, first and second recess, partition and outlet nozzle that are or may be in contact with the metal to be cast, are lined with, or made from a refractory material.

In use, the metal to be cast is fed in molten state as a stream from the ladle into the pouring box, where it is subjected to great turbulences. This allows the tundish according to the invention to be used as an "open chemical reactor" in which it is possible to introduce additives or alloys beneath a thick metal layer in a very well mixed volume, where disolution rate is maximized.

Then, the molten metal flows from the pouring box towards the flotation box through the first recess under the partition, thereby preventing any slag present in the pouring box from being entrained. The molten metal flowing out of the first recess into the flotation box forms an upward stream rising from the bottom of this first recess along the partition, thereby allowing optimal inclusion separation and substantial reduction of dead volume zones in the basin downstream the partition.

Thereafter, the molten metal flows along the entire length of the flotation box in a very uniform manner without any short circuit, thereby allowing optimum plug flow volume to achieve high inclusion separation.

Last of all, the molten metal reaching the second recess and filling it up, forms in this second recess an antivortex volume above the outlet nozzle, which allows reduction of the amount of metal retained in the tundish. Indeed, this second recess provides the extra depth required to avoid turbulences even if the flotation box is emptied completely. The stream around the nozzle is directly sucked in and does not rebound on the rear wall.

In accordance with a preferred embodiment of the invention, the opposite end walls of the basin are upwardly and outwardly inclined and the opposite walls of the first recess and perpendicular to the bottom walls of the basin and first recess, respectively. In addition, the bottom wall of the second recess is preferably joined to the bottom wall of the basin by a wall upwardly inclined in a direction opposite to the other end wall of the basin adjacent the second recess, so as to smoothly direct the molten metal toward the central opening and thus reduce as much as possible turbulences.

It is worth mentioning that the portion of the bottom of the basin between the one end wall thereof and the first recess may be sized to act as, or receive, a molten metal stream breaker, thereby improving mixing inside the pouring box.

BRIEF DESCRIPTION OF THE DRAWINGS

The invention and its numerous advantages will be better understood on reading the following non restrictive description of a preferred embodiment thereof, made with reference to the accompanying drawings in which.

DETAILED DESCRIPTION OF THE INVENTION

Figure 1:
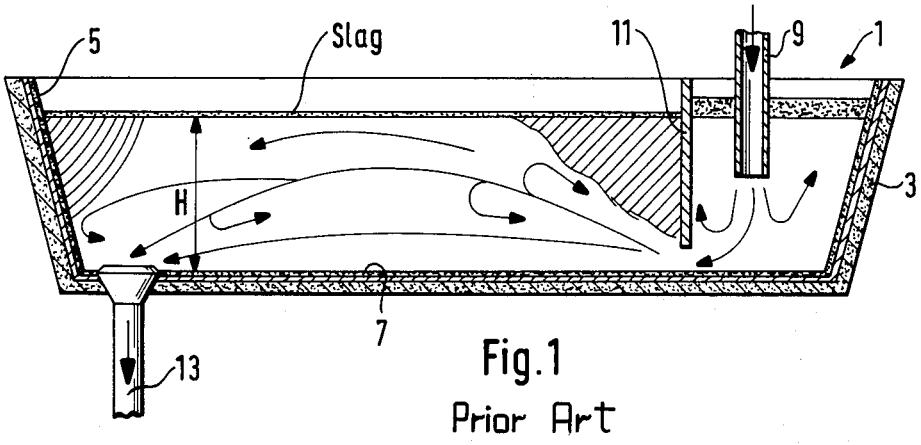
Fig.1 Prior Art
FIG. 1 is a schematic representation of a conventional tundish provided with a flat bottom and a transversal partition, which tundish is shown in longitudinal cross-section.

The tundish 1 shown in FIG. 1 is a conventional structure and comprises an elongated vessel 3 whose internal walls in contact with the molten metal, are lined with a refractory material 5. The vessel 3 which usually has an upwardly open, trapezoidal cross-section and a flat bottom 7 may be, for example, 412 cm long, 115 cm width and 90 cm height in order to handle the amount of molten metal usually poured from a standard 150 tons ladle.

The molten metal is poured at one end of the vessel through a shroud 9, upstream a transversal partition 11 extending transversally across the vessel from the top of the tundish down to a short distance from its bottom wall 7. The main purposes of this partition 11 are to increase the residence time of the molten metal inside the tundish, improve the mixed flow volume in the same and t permit slag.

Previous studies carried out with such a tundish have shown however that the use of such a partition 11 has no significant effect on the total fraction of the dead entrapment volume. As a matter of fact, the use of such a partition 11 rather creates two major dead flow volume zones shown in hatched lines in FIG. 1, down stream the partition. In addition to these dead volume zones, numerous currents and turbulences are created inside the tundish upstream and downstream the partition 11, as shown with arrows in FIG. 1, which currents and turbulences reduce the inclusion separation and the internal cleanliness of the tundish.

At the other end of the vessel 3, the molten metal flows out from the tundish through a nozzle 13 into a water cooled mold (not shown) which may, for example, be 17.5 cm thick. To prevent vortexing above the tundish nozzle 13 and slag entrainment into the mold, it is compulsory to keep the metal level in the tundish at a height of at least 20 cm above the nozzle 13. Usually, the molten metal height inside the tundish is maintained at about 82 cm during casting. When casting is completed, it is however required to keep into the tundish an amount of molten metal of at least 20 cm high, thereby substantially reducing the metallic yield as was explained hereinabove in the Background of the Invention.

In use, the ladle stream may be shrouded and argon may be injected into the ladle shroud. Nominal casting speeds may vary from 100 cm/min to 150 cm/min depending on the width of the slabs to be cast and the molten metal temperature. In practice, slabs of 6.1 m long with width varying from 0.814 to 1.524 m are currently casted.

Figure 2:
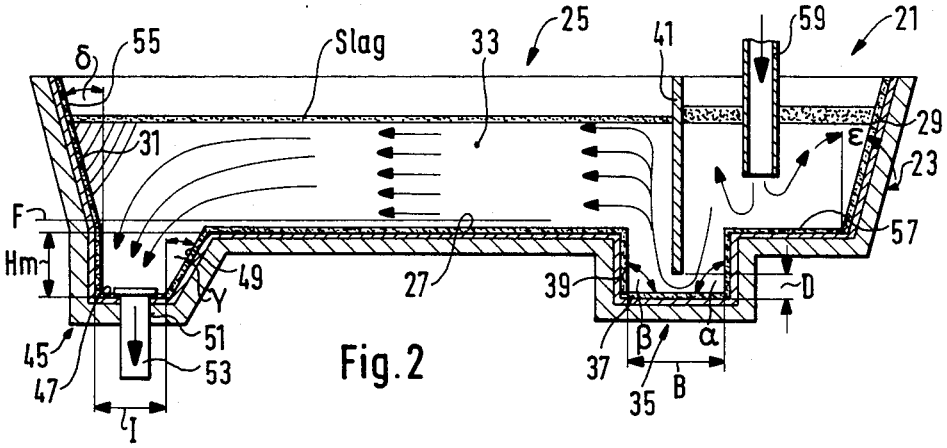
FIG. 2 is a schematic representation of a tundish according to the invention, shown in longitudinal cross-section.

The tundish 21 according to the invention as shown in FIG. 2 also comprises an elongated vessel or basin 23 having an open top 25, a flat bottom wall 27, a pair of opposite end walls 29 and 31 and a pair of opposite side walls 33. In transversal cross-section, the tundish 21 may be in the shape of an inverted trapezium or of any other cross-sectional shape used in the industry.

In accordance with the invention, a first recess 35 hereinafter also called "flow orientation and slag retainer box", is provided in the bottom wall 27 of the basin at a given distance A from the end wall 29. This first recess 35 extends downwardly and transversally across the basin between the side walls 33, and has a bottom wall 37 and a pair of opposite walls 39 perpendicular to the side wall 33 of the basin.

A vertical partition 41 extends transversaly across the basin between the side walls 33 just over the first recess 35. The partition 41 extends vertically from the top of the basin down into the first recess 31 at about mid distance between the opposite walls 39 of this recess. The partition 41 which stops short from the bottom wall of the first recess, forms therewith the kind of baffle to which the molten metal must flow, and divides the basin into a first portion hereinafter called "pouring box" extending from the partition 41 towards the one end wall 29 of the basin, and a second portion hereinafter called "flotation box" extending from the partition 41 towards the other end 31 of the bassin.

A second recess 45 hereinafter also called "anti-vortex box", is provided in the bottom wall 27 of the basin adjacent the other end wall 31 of this basin. This second recess 45 extends downwardly and transversally across the basin between the side walls 33 and has a bottom wall 47 provided with a central opening 51. An outlet nozzle 53 extends downwardly from the central opening of the second recess through the bottom wall thereof.

As clearly shown in FIG. 2, the opposite end walls 29 and 31 of the bassin are upwardly and outwardly inclined at angle respectively designated as $\epsilon$ and $\alpha$. As also shown in FIG. 2, the opposite walls 39 for the first recess 35 are parallel and perpendicular to the bottom walls 27 and 37 of the bassin and first recess respectively. However, it is worth mentioning that these opposite walls 39 could also be upwardly and outwardly inclined at respective angles of $\alpha$ and $\beta$ if desired. As further shown in FIG. 2, the bottom wall 47 of the second recess 45 is joined to the bottom wall 27 to the basin by a wall 49 upwardly inclined at an angle $\alpha$, in a direction opposite to the other end wall 31 of the basin adjacent the second recess, so as to smoothly direct the molten metal toward the central opening 51 and thus reduce as much as possible turbulences.

Of course, all of the walls of the basin 23, the first and second recesses 35 and 45, the partition 41 and the outlet nozzle 53 that are or may be in contact with the molten metal to be cast, are lined with or made from a refractory material 55.

In use, the metal to be cast is fed in molten state as a stream from the ladle (not shown) into the pouring box preferably through a shroud 59, upstream the partition 41. In the pouring box, alloys can be deeply injected, thereby preventing vapours from escaping when tundish metallurgy is to be carried out.

In this connection, it is worth mentioning that the portion 57 of the bottom wall 27 of the bassin between the one end wall 29 thereof and the first recess is advantageously sized to act as a metal stream breaker to reduce the injection energy of the molten metal and present the same from flowing out of the pouring box at a too high speed. Alternatively, the portion 57 of the bottom wall 27 may be used as a support for an external stream breaker that can be attached to or positioned under the injection nozzle 59.

After injection, the molten metal flows under the partition 41, from the pouring box into the flotation box through the flow orientation and slag retainer box 35, thereby preventing any slag present in the pouring box from being entrained. In addition of preventing such an entrainment of the slag, the flow orientation box 35 causes formation of an upward stream rising from the bottom of the first recess 35 along the partition 41. This is of the uppermost importance since this allows optimal inclusion separation and substantial reduction of dead volume zones in the basin downstream the partition 41.

Then, the molten metal flows along the entire length of the flotation box in a very uniform manner without any "short circuit", thereby allowing optimum plug flow volume. In the flotation box, the height of metal is minimal, which is very favourable for inclusion separation. In addition, as shown with arrows in FIG. 2, the flow is mostly of the plug flow type and the slag layer is less perturbed, thus easing the emergence of inclusions and avoiding their entrainement from the slag layer.

At the opposite end of the tundish 21, the molten metal reaches the second recess 45 and files it up to form in this second recess an antivortex volume above the outlet nozzle. Advantageously, the height Hm of the antivortex box is selected to keep a head of 20 cm of metal above the nozzle orifice as it is of ususal practise to avoid slag entrainment. Thanks to this antivortex box, the flotation box can be emptied almost completely, thereby allowing substantial reduction in the amount of metal "lost" in the tundish after every casting sequence.

As can now be understood, the tundish according to the invention as shown in FIG. 2 comprises four consecutive boxes each of which has its own utility.

The pouring box upstream the partition 41 provides a favourable site for alloy additions with extra injection depth without causing perturbations on the flow orientation box 35. As a result, it becomes possible to introduce any alloy addition beneath a thick metal layer in a very well-mixed volume, where dissolution rate is maximized.

The flow orientation box defined by the first recess 35 provides an extra step which forces the metal stream down and up. This box acts as a good barrier which prevents from carrying over reoxydation and desoxydation products espacially when the level in the tundish is low. In addition, the upward movement of the metal just behind the partition 41 eliminates almost most of the stagnant volume in the tundish.

The flotation box downstream the partition 41 has a height which can be minimal, thereby making the box very favourable for inclusion separation. The flow is mostly of the plug flow type and the slag layer is less perturbated, thus easying the emergence of inclusions.

Last of all, the antivortex box defined by the second recess 45 provides the extra depth required to avoid turbulence even if the flotation box is emptied completely. In addition, the streams around the nozzle are directly. sucked in and do not bound on the rear wall.

The four boxes listed hereinabove must be used altogether to achieve the requested optimization of the tundish characteristics.

The tundish 21 according to the invention can be manufactured as such. Alternatively, it can be manufactured from a conventional tundish by adding a flow orientation box 35 and an antivortex box 45 either by welding two appendices under the flat bottom wall of the conventional tundish or by creating the requested differences in level by placing proper refractory blocks onto the bottom wall surface of the conventional tundish inside the same.

In all cases, the tundish according to the invention which can be visualized as a succession of four boxes is less sensitive to fluctuations occurring with ladle changes during sequence casting, than the conventional straight through tundish, thereby improving the quality performance in continuously cast metal slabs, especially continuous cast steel slabs.

The dimensions and angles of the tundish according to the invention as shown in FIG. 2 are not essential as such and may be selected as a function of different parameters, such as:

the size of the slabs to be cast;

the extraction speed; and/or the room available inside the casting plant between a casting ladle and casting mold.

By way of example, the dimensions shown as the letters B, D, F and Hm in FIG. 2 of a tundish according to the invention for use in continuously casting steel slabs at an extraction speed of 40 to 60 inches per minute, the slabs being 7.5 inches thick at 36 to 60 inches width, may be as follows:

B: 19.5 inches

D: 5 inches

F: 24 inches

Hm: 15 inches

Comparative tests were carried out on full scale water models of a conventional tundish as shown in FIG. 1 and a tundish according to the invention. Water modeling was conducted in the Ecole Polytechnique de Montreal's Laboratory.

The tundishes were made from 19 mm. thick lucite sheets to allow visualization of the flow stream under different operating conditions in relationship with vortexing and slag entrainment. A 7.62 cm diameter ABS pipe was used to simulate the ladle shroud and a real tundish-to-mold submergence nozzle was set in the bottom of the tundish at the other thereof. Flow from the tundishes into the mold was controlled by a stopper rod suspended above the nozzle entry and linked to a manual lever.

Flow visualization was achieved by injecting a fixed amount of potassium permanganate tracer into the ladle stream. An optical probe was fixed at the entry of the submerged nozzle and readings of water transmittance were recorded by a chart recorder via a colorimeter.

The respective proportions of well-mixed flow, plug flow and dead flow volumes were derived from the peak concentration, mean time and minimum retention time by using a stimulus response technique.

The slag entrainment was visualized by using red polyethylene beads having a diameter varying from 2 to 3 mm and a density of 0.8. Colored photographs and video-tapes were taken for various configurations tested.

Figure 3:
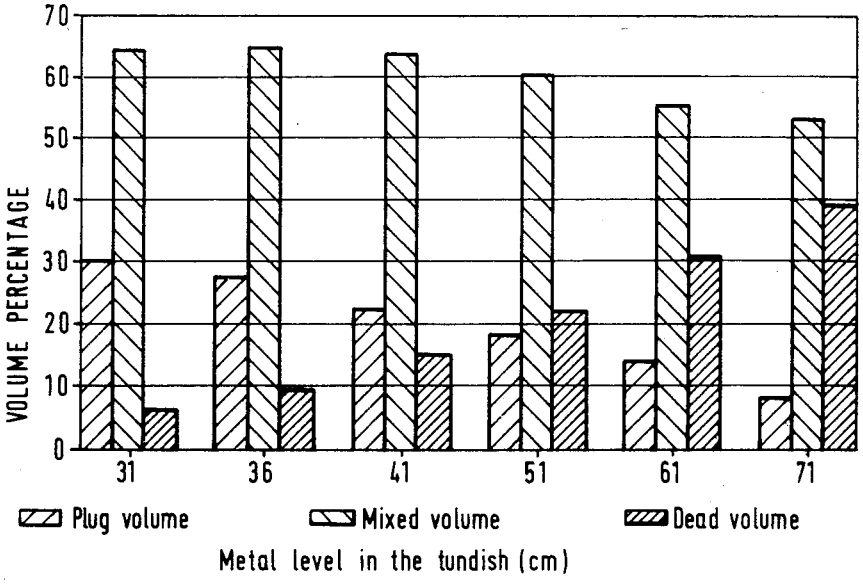
FIG. 3 is a schematic representation of the percentages of plug volume, mixed volume and dead volume at various metal level in a conventional tundish as shown in FIG. 1.

The results that were so obtained, are as follows:

Fractions of the well mixed, plug flow and stagnant volume obtained at different levels with a conventional tundish provided with only one single partition as shown in FIG. 1, are reported in FIG. 3.

Figure 4:
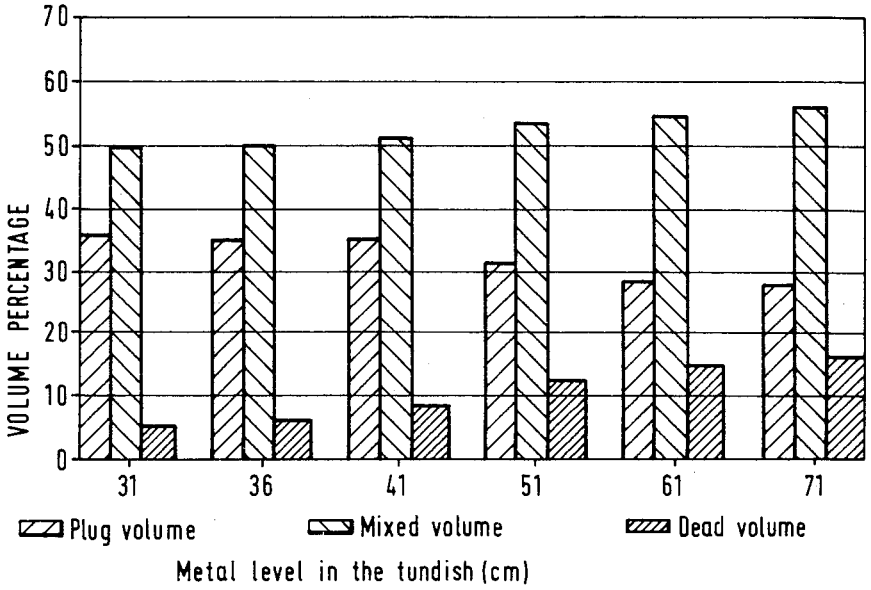
FIG. 4 is a schematic representation of the percentages of plug volume, mixed volume and dead volume at various metal levels in the tundish according to the invention as shown in FIG. 2.
Figure 5:
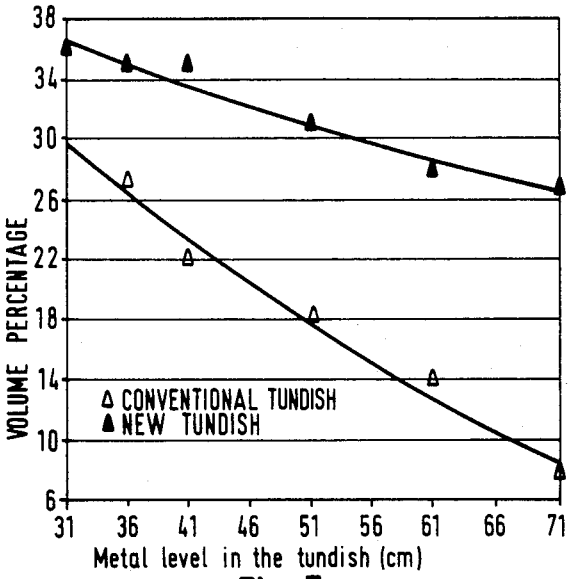
FIG. 5 is a schematic representation of the variation of the plug volume at various metal levels in a conventional tundish as shown in FIG. 1, and a tundish according to the invention as shown in FIG. 2.

The same fractions obtained with a tundish according to the invention as shown in FIG. 2. are reported in FIG. 4.

In addition, comparative datas are reported in the graphs shown in FIGS. 5 to 8.

As can be seen, the tundish according to the invention has a plug flow volume fraction which is enhanced significantly. In addition, it also has a dead zone volume fraction which is substantially decreased, at all water levels in the tundish. The upward stream rising from the bottom of the first recess 35 of the tundish 21 according to the invention has proved to be particularly efficient to carry the polyethylene beads (acting as slag) to the surface and prevent the same from being entrained from the pouring box to the flotation box. This upward stream has also completely eliminated the dead volume zone behind the partition 41 in addition of allowing the development of a plug flow volume on the entire length of the flotation box and a smoothing of the flow in the antivortex box 45.

Figure 6:
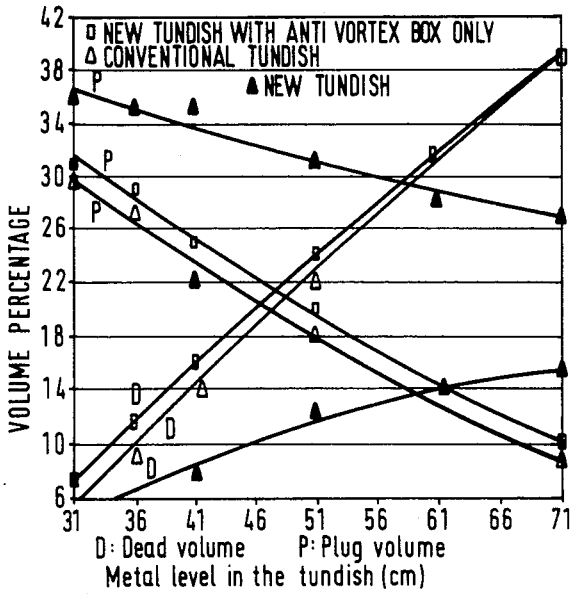
FIG. 6 is a schematic representation of the variation of the dead volume and plug volume is a tundish according to the invention as shown in FIG. 2 and a tundish similar to the one of FIG. 2 without any first recess.
Figure 7:
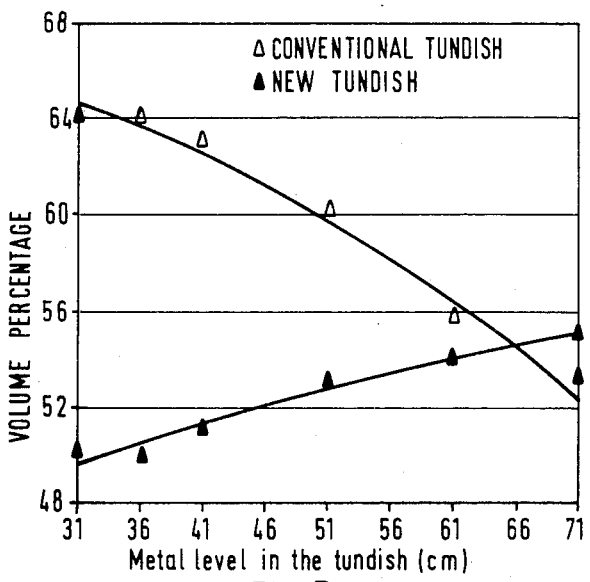
FIG. 7 is a schematic representation of the variation of the well-mixed volume at various metal levels in a conventional tundish a shown in FIG. 1 and a tundish according to the invention as shown in FIG. 2.
Figure 8:
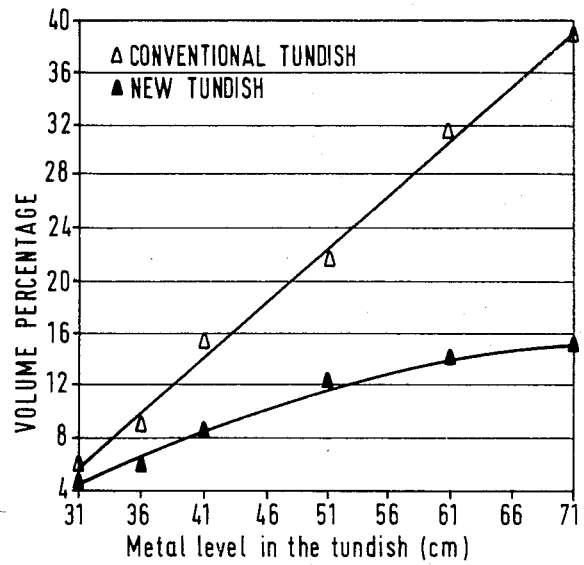
FIG. 8 is a schematic representation of the variation of the dead volume at various metal levels in a conventional tundish as shown in FIG. 1 and a tundish according to the invention as shown in FIG. 2.

As clearly shown in FIG. 6, it is compulsory to use simultaneously a flotation box 35 and an antivortex box 45 to achieve the requested optimization. Indeed, in the tests reported in this FIG. 6, comparison was made with a conventional tundish, a tundish provided with an antivortex box 45 only, and a tundish according to the invention provided with an antivortex box and a flow orientation box 35. The results of these tests show clearly the importance of the flow orientation and slag retainer box 35. Indeed, the graph clearly shows that the addition of an antivortex box 45 only has a very small bonification effect on the portions of the plug flow and dead volume zones. This, of course can be easily explained as the essential role of the antivortex box 45 is exclusively to create the pressure head on top of the tundish nozzle 57 to avoid turbulences and vortex.

What is claimed is:

1. A tundish for use in combination with a casting ladle and a casting mold to continuously cast metal slabs, said tundish comprising:

an elongated basin having an open top, a flat bottom wall, a pair of opposite end walls and a pair of opposite side walls;

a first recess provided in the bottom wall of the basin at a given distance from one of the opposite end walls of said basin, said first recess extending downwardly and transversally across said basin between the side walls thereof and having a bottom wall and a pair of opposite walls perpendicular to the side walls of said basin;

a vertical partition extending transversally across the basin between the side walls thereof just over the first recess, said partition extending vertically from the top of the basin down into said first recess at about mid distance between the opposite walls thereof, said partition stopping short from the bottom wall of said recess to form therewith a baffle;

a second recess provided in the bottom wall of the basin adjacent the other end wall thereof, said second recess extending downwardly and transversally across said basin between the side walls thereof and having a bottom wall provided with a central opening; and an outlet nozzle extending downwardly from the central opening of said second recess through the bottom wall thereof;

wherein said vertical partition divides said basin into a first portion hereinafter called "pouring box", extending from said partition toward the one end wall of the basin, and a second portion hereinafter called "flotation box", extending from said partition toward the other end wall of said basin;

wherein all of the walls of the basin, first and second recesses, partition and outlet nozzle that are or may be in contact with the metal to be cast are lined with or made from a refractory material;

wherein, in use, the metal to be cast is fed in molten state as a stream from the ladle into the pouring box where it is subjected to great turbulences;

wherein the molten metal flows from the pouring box towards the flotation box through the first recess under the partition, thereby preventing any slag present, in the pouring box from being entrained;

wherein the molten metal flowing out of the first recess into the flotation box forms an upward stream rising from the bottom of said first recess along state partition, thereby allowing optimal inclusions separation and substantial reduction of dead volume zones in the basin downstream said partition;

wherein the molten metal flows along the entire length of the flotation box in a very uniform manner without any short circuit, thereby allowing optimum plug flow volume; and wherein the molten metal reaching the second recess and filling it up, forms in said second recess an antivortex volume above the outlet nozzle, thereby allowing reduction of the amount of metal in the tundish.

2. The tundish of claim 1, wherein:

the opposite end walls of the basin are upwardly and outwardly inclined;

the opposite walls of the first recess perpendicular to the side walls of the basin are parallel and perpendicular to the bottom walls of said basin and first recess, respectively; and the bottom wall of the second recess is joined to the bottom wall of the basin by a wall upwardly inclined in a direction opposite to the other end wall of the basin adjacent said second recess, so as to smoothly direct the molten metal towards the central opening and reduce as much as possible turbulences.

* * * * *